US006233982B1

(12) United States Patent
Thies

(10) Patent No.: US 6,233,982 B1
(45) Date of Patent: May 22, 2001

(54) METHOD AND DEVICE FOR THE TREATMENT OF READY-TO-WEAR, TEXTILE APPAREL PARTS

(75) Inventor: Alfred Thies, Maienfeld (CH)

(73) Assignee: Thies AG, Maienfeld (CH)

( * ) Notice: Subject to any disclaimer, the term of this patent is extended or adjusted under 35 U.S.C. 154(b) by 0 days.

(21) Appl. No.: 08/628,013

(22) Filed: Apr. 4, 1996

(30) Foreign Application Priority Data

Apr. 13, 1995 (DE) ..... 195 14 012
Apr. 3, 1996 (DE) ..... 196 13 361

(51) Int. Cl.[7] ..... D06B 1/02

(52) U.S. Cl. ..... 68/148; 68/184; 68/181; 68/207

(58) Field of Search ..... 68/184, 189, 207, 68/181, 148; 8/158; 134/141, 188

(56) References Cited

U.S. PATENT DOCUMENTS

| | | | | |
|---|---|---|---|---|
| 957,801 | * | 5/1910 | Richardson et al. | 68/184 |
| 1,496,644 | * | 6/1924 | Karasinski | 68/148 |
| 1,719,586 | * | 7/1929 | Bugge | 68/184 |
| 1,850,138 | * | 3/1932 | Riall | 68/148 |
| 1,902,165 | * | 3/1933 | Hansen | 68/184 |
| 2,031,788 | * | 2/1936 | Persoons et al. | 68/184 |
| 2,437,968 | * | 3/1948 | Palotsee . | |
| 2,548,740 | * | 4/1951 | Rugh | 68/184 |
| 2,577,727 | * | 12/1951 | Abbot | 68/189 |
| 2,584,833 | * | 2/1952 | Beucler | 68/148 |
| 2,633,009 | * | 3/1953 | Steverlynck | 68/184 |
| 2,968,938 | * | 1/1961 | Frohnapel et al. | 134/141 |
| 2,985,502 | * | 5/1961 | Kronsbein et al. | 8/158 |
| 3,066,521 | * | 12/1962 | Gillessen | 68/148 |
| 3,293,890 | * | 12/1966 | Valdespino et al. | 68/184 |
| 3,438,072 | * | 4/1969 | Heskestad | 8/158 |
| 3,444,710 | * | 5/1969 | Gaugler et al. | 68/184 |
| 3,593,545 | * | 7/1971 | Blumenkamp | 68/184 |
| 3,785,180 | * | 1/1974 | Luckenback et al | 68/184 |
| 3,927,972 | | 12/1975 | Kawamura et al. . | |
| 4,744,228 | * | 5/1988 | Goldberg | 68/184 |
| 5,113,881 | * | 5/1992 | Lin et al. | 134/163 |
| 5,161,394 | * | 11/1992 | Felzer | 68/207 |
| 5,210,896 | | 5/1993 | Hertig et al. . | |
| 5,502,856 | * | 4/1996 | Smith | 68/184 |
| 5,857,362 | * | 1/1999 | Oh et al. | 68/148 |

FOREIGN PATENT DOCUMENTS

| | | | | |
|---|---|---|---|---|
| 519 474 | | 5/1953 | (BE) . | |
| 61190 | * | 4/1912 | (CH) | 68/148 |
| 947 604 | | 8/1956 | (DE) . | |
| 2628879 | * | 1/1977 | (DE) | 8/158 |
| 2534618 | * | 2/1977 | (DE) | 68/189 |
| 28 15 994 | | 10/1978 | (DE) . | |
| 37 34 314 | | 4/1989 | (DE) . | |
| 1 156 194 | | 12/1957 | (FR) . | |
| 442915 | * | 2/1936 | (GB) | 68/148 |
| 854 221 | | 11/1960 | (GB) . | |
| 1203494 | | 8/1970 | (GB) . | |

* cited by examiner

*Primary Examiner*—Frankie L. Stinson
(74) *Attorney, Agent, or Firm*—Proskauer Rose LLP

(57) ABSTRACT

A device as well as a method for the treatment of ready-to-wear, textile apparel parts, particularly for the pretreatment and/or dyeing are described, according to which the ready-to-wear, textile apparel parts to be treated are arranged in cylindrical or cylinder-like fabric carrier being arranged in a preferably closable vessel, where the parts are brought into contact with a treatment bath, whereby the fabric carrier is moved within the apparatus during the treatment. Hereby the ready-to-wear, textile apparel parts are arranged in the fabric carrier as a heap of ready-to-wear, textile apparel parts. During the treatment the vessel is filled with the bath only to such an extent and the treatment bath is pumped through the fabric carrier in that way that the ready-to-wear apparel parts are displaced and particularly intermingled by the treatment bath streaming through the fabric carrier.

18 Claims, 2 Drawing Sheets

METHOD AND DEVICE FOR THE TREATMENT OF READY-TO-WEAR, TEXTILE APPAREL PARTS

The present invention concerns a method for the treatment of ready-to-wear, textile apparel parts having the features of the invention and a device to carry out the method having the features of the invention.

BACKGROUND OF THE INVENTION

Concerning the treatment, particularly the pretreatment and/or dyeing of ready-to-wear, textile apparel parts as, for example, pants, skirts, dresses, blouses, sweat-shirts, T-shirts and so on, according to the industrial scale, the DE 37 34 314 A shows that these ready-to-wear, textile apparel parts to be treated are arranged in a cylindrical or cylinder-like fabric carrier. Hereby this basket-like fabric carrier is arranged preferably in a closable vessel, whereby the fabric carrier is arranged horizontally in the vessel relative to its central, longitudinal axis.

Furthermore the basket-like fabric carrier used in the known method immerses approximately half way into the treatment bath, so that the ready-to-wear, textile apparel parts arranged within the cylindrical or cylinder-like fabric carrier are on one hand displaced and on the other hand brought into contact with the corresponding treatment bath during a rotation of the fabric carrier. The perforated inner jacket of the fabric carrier can have ribs extending axially that improve the afore mentioned displacement and a radial superfusing of the fabric carrier by the bath during the rotation of the fabric carrier.

Conditioned by the fact that, according to the known method, during the treatment, the ready-to-wear, textile apparel parts are brought into contact with the treatment bath by the rotation of the cylindrical or cylinder-like fabric carrier and that thereby high centrifugal forces are intentively avoided, the known method requires long treatment times and extremely high bath ratios being ecologically and economically questionable. This again means that the known method shows the further disadvantage that the maximum portion is limited to a weight of between 80 kg to 100 kg of the ready-to-wear, textile apparel parts, since a sufficient dyeing of the textile apparel parts during the treatment is only guaranteed when the textile apparel parts have enough space within the fabric carrier and when they can float in the treatment bath.

SUMMARY OF THE INVENTION

The object of the present invention is to dispose a method as well as a device for the treatment of ready-to-wear, textile apparel parts, particularly for the pretreatment and/or dyeing, whereby this method, respectively this device allows a particularly regular treatment of the ready-to-wear, textile apparel parts to be treated at a relatively low bath ratio.

According to the invention this object is realized by a method with the significant characteristics of the invention as well as by a device with the significant characteristics of patent claim 11.

The inventive method for the treatment of ready-to-wear, textile apparel parts, particularly for the pretreatment and/or dyeing, provides an arrangement of the ready-to-wear, textile apparel parts to be treated that have the initially mentioned characteristics in a cylindrical or cylinder-like fabric carrier. Hereby the cylindrical or cylinder-like fabric carrier being from now also briefly called pack cylinder, is arranged in a preferably closable vessel during the treatment, whereby the pack cylinder filled with the ready-to-wear, textile apparel parts is moved within the vessel during the treatment of the textile apparel parts. According to the inventive method the ready-to-wear, textile apparel parts to be treated are arranged as a heap of ready-to-wear, textile apparel parts in the pack cylinder, whereby, according to the inventive method, the vessel is filled with the treatment bath only to such an extent and the treatment bath is pumped through the fabric carrier and thus through the heap of the ready-to-wear, textile apparel parts in that way that the ready-to-wear, textile apparel parts are displaced and particularly intermingled by the treatment bath flowing in the fabric carrier. In other words, the inventive method is different to the initially mentioned prior art mainly in that way that in the inventive method the ready-to-wear, textile apparel parts to be treated are displaced and at the same time also pretreated and/or dyed by the treatment bath superfusing the fabric carrier at a high speed, whereby therefore the treatment bath is pumped through the pack cylinder and thus also through the heap of the ready-to-wear, textile apparel parts to be treated.

The inventive method is based on the surprising fact that the ready-to-wear, textile apparel parts are impeccably displaced and perfused, respectively superfused despite the extremely low bath ratio (weight of ready-to-wear apparel parts:volume of treatment bath) used in the inventive method, so that particularly regular treatment effects, particularly dyeings, result within a very short time. This is even more amazing for the reason that specialists still in these day have the opinion that ready-to-wear, textile apparel parts can be regularly treated and homogeneously dyed only if this treatment, respectively dyeing, is carried out at an extremely high bath ratio.

The inventive method shows several advantages. As it is mentioned above, first of all as a first advantage it is to be pointed out that the inventive method, compared to the known method, allows the treatment of ready-to-wear, textile apparel parts at an essentially lower bath ratio than in the known method. This means exactly that the inventive method proceeds at a bath ratio (weight of ready-to-wear, textile apparel parts to be treated:volume of bath) of only about 10% to 30% of the bath ratio that is required for the usual method. This again leads to the fact that in the inventive method, compared to the usual method, extremely less water, chemicals, dyestuffs and energy are necessary and that correspondingly essentially less effluents emerge. For that reason the inventive method is not only ecologically but also economically more advantageous than the usual method. Furthermore it was surprisingly noted that the treatment effects being achievable by the inventive method as, for example, the residue values achievable by boiling, washing, desizing or the degree of whiteness achievable by bleaching or the regularities, the color depth and/or the colorfastness obtainable by dyeing, are much better and more homogeneous than in the usual method, even though the inventive method proceeds, as already described above, at an essentially lower bath ratio and even though in the inventive method the ready-to-wear, textile apparel parts which from now on are also called textile goods are formed as a heap of ready-to-wear, textile apparel parts. This improvement is caused by the fact that hereby on one hand an undesired formation of channels between the single parts and the formation of dead zones in the flow are avoided caused by the arrangement of the textile goods in a heap of textile goods and by the displacement during the treatment. On the other hand another reason for this improvement is that the treatment bath necessarily perfuses, respectively and particularly superfuses, the textile goods to be correspondingly treated at a high speed, since the treatment bath is pumped through the textile goods arranged in the pack cylinder. Furthermore the inventive method, compared to the usual method, allows a essential reduction of the treatment time, particularly of about 30% to 50%. This has next to the economical advantage also the advantage that the textile goods to be treated are stressed less during the treatment. This again causes a longer permanency of the textile goods treated according to the inventive method.

Moreover it was surprisingly noted that despite the high displacement of the textile ready-to-wear apparel parts an undesired damaging, particularly an undesired creasing and fixing of creases, did not occur during the treatment, even though the textile apparel parts to be correspondingly treated did not float in the treatment bath as this was the case in the afore mentioned known method.

In order to achieve a particular homogeneous treatment of the textile goods a further embodiment of the inventive method is characterized in that hereby the cylindrical or cylinder-like fabric carrier is arranged vertically within the vessel and is rotated about its central, vertical axis during the treatment. In other words, the pack cylinder is arranged in the vessel in that way that its circular basis is aligned in direction of the bottom of the vessel which is, regarding its shape, adjusted to the cylindrical or cylinder-like fabric carrier. The rotation of the pack cylinder carried out during the treatment hereby causes the fact that the treatment bath particularly homogeneously perfuses, respectively and particularly superfuses and additionally displaces at a high speed the total amount of the textile goods arranged in the pack cylinder. This explains the already above mentioned particularly good and homogeneous treatment effects.

According to the inventive method, the rotation speed of the fabric carrier is adjusted depending on the desired treatment, on the textile goods to be treated and on the bath ratio. Usually this rotation speed varies between 1 rotation/min and 30 rotations/min, preferably between 2 rotations/min and 8 rotations/min.

In order to cause the above described rotation of the pack cylinder in the inventive method, a further embodiment of the inventive method is characterized in that the treatment bath is pumped through the fabric carrier in that way that the ready-to-wear, textile apparel parts arranged therein are mainly not only perfused but particularly superfused by the treatment bath.

In a particularly suitable embodiment of the inventive method the treatment bath is divided into at least two partial flows, particularly into two to ten partial flows before it is brought into contact with the textile apparel parts. For that reason particularly during the dyeing it is achieved that within the pack cylinder filled with the textile goods to be treated no sections occur in which the textile goods are treated in a different way than in the neighbouring sections.

Concerning the economical and the ecological aspects an embodiment of the inventive method is to be pointed out being characterized in that the treatment bath pumped through the pack cylinder is used for the moving, particularly for the rotating of the fabric carrier. In other words, in this embodiment of the inventive method the treatment bath does not only serve for the transmission of products and energy but at the same time the flowing treatment bath is used to cause a moving of the fabric carrier and particularly a rotation of the fabric carrier about its vertical axis. This additionally shows the advantage that a device used herefore, as it is described later, has a particularly simple construction and correspondingly has also low manufacturing costs.

In connection with the inventive method it is described above that hereby the textile goods (ready-to-wear, textile apparel parts) to be treated are arranged as a heap of textile goods in the pack cylinder. This means, within the present description, each ordered and inordinate arranging of the textile goods into the pack cylinder, whereby it is also possible to arrange the textile goods layerwise into the pack cylinder.

Concerning an essential advantage of the inventive method compared to the known method it was initially pointed out that the treatment, according to the inventive method, can be carried out at an essentially lower bath ratio. According to the inventive method it is particularly advisable to carry out the treatment at a bath ratio of between 1:0.5 to 1:20, preferably at a bath ratio of between 1:2 to 1:8.

In order to obtain in the inventive method particularly homogeneous treatment effects as, for example, less residues or a particularly high degree of whiteness during the pretreatment or particularly well regularities, deep colors and/or a high colorfastness during the dyeing, a further embodiment of the inventive method is characterized in that the treatment bath is pumped in that way that the whole treatment bath superfuses, respectively perfuses, and correspondingly displaces the textile goods arranged within the pack cylinder one to ten times per minute of treatment, preferably two to six times per minute of treatment.

According to a further embodiment of the inventive method being particularly advantageous because of its economic efficiency, the fabric carrier is removed out of the vessel in order to be charged with the ready-to-wear, textile apparel parts to be treated and/or in order to be discharged. In other words, according to this embodiment of the inventive method the pack cylinder is charged with the textile goods outside of the vessel, so that at the same time another pack cylinder charged with the textile goods can be treated within the vessel, so that correspondingly the nonproductive time periods are reduced to a minimum. This embodiment of the inventive method essentially facilitates the disposition of the procedure. Such an external charging, respectively discharging, of the pack cylinder is impossible in the known method, since hereby a device is applied in which the pack cylinder is connected undetachably to the vessel. Moreover this embodiment of the inventive method makes it possible to essentially facilitate particularly the charging and the discharging of high-volume pack cylinders. Furthermore it is possible to optimumly arrange the textile goods to be treated within the pack cylinder.

In order to additionally achieve in the inventive method a shorter treatment time, it is advisable to enter the textile goods wet into the pack cylinder or to wet the textile goods with water during its entering into the pack cylinder, so that such prewatered textile goods can be deaerated essentially easier and faster at the beginning of the corresponding treatment, which again is positive for the treatment effects.

The present invention moreover concerns a device to carry out the above described method.

The inventive device to carry out the above described method contains a cylindrical or cylinder-like fabric carrier being movably positioned for the uptaking of the ready-to-wear, textile apparel parts to be treated. Hereby the fabric carrier is detachably arranged in a vessel being adjusted, regarding its shape and dimensions, to the fabric carrier during the treatment in that way that the circular basis of the cylindrical or cylinder-like fabric carrier is mainly aligned parallel to the floor space of the vessel, whereby the fabric carrier is provided with a drive in order to actuate the fabric carrier. The inventive device furthermore contains a system for the bath circulation being provided with at least one pump for pumping the treatment bath, whereby the fabric carrier (pack cylinder) is detachably arranged within the vessel.

The inventive device shows analogously all the advantages as they are already described above for the inventive method. Using the inventive device it is particularly possible to impeccably treat a large amount of textile goods (ready-to-wear, textile apparel parts) with a relatively low volume of treatment bath, so that the inventive device involves particularly low costs regarding its purchase and its use, since because of its high treatment capacity it replaces several conventionally constructed devices. This again also leads to an essential economy regarding the personnel. For the fact that in the inventive device the fabric carrier is detachably arranged in the vessel it can be removed out of the vessel in order to be charged and/or discharged with the textile goods to be treated, so that then, according to the inventive device, no undesired nonproductive time periods occur when the fabric carrier is removed out of the vessel at the end of the treatment and replaced by another fabric carrier being already externally charged. The removed fabric carrier is then discharged externally of the vessel and refilled with the textile goods to be treated, whereby this extern discharging, respectively charging shows additionally to the reduction of the nonproductive time periods the advantage that hereby the charging, respectively the discharging, of the pack cylinder is evidently simplified and facilitated.

Basically, according to the inventive device, the drive for the actuation of the pack cylinder can be provided in any way, for example, as an electrical drive as it is described later in a detailed example.

In a first embodiment of the inventive device the drive is formed as a hydraulic drive, whereby it is particularly and economically suitable, in respect to the manufacturing costs and/or the costs for the use, when the drive is provided in the way that the fabric carrier is actuated, particularly rotated about its central, vertical axis by the pumped-in treatment bath.

For the formation of the hydraulic drive, according to the inventive device, a further embodiment of the inventive device is characterized in that the hydraulic drive contains at least one rotor blade assigned to the fabric carrier and detachably or particularly undetachably connected with the fabric carrier. Hereby the at least one rotor blade is positioned within the vessel in that way that the at least one rotor blade changes the flow direction of the treatment bath entering into the vessel in the way that the treatment bath mainly axially superfuses the cylindrical or cylinder-like fabric carrier (pack cylinder). In other words, the at least one rotor blade causes the fact that on one hand the pack cylinder is actuated, preferably rotated and on the other hand the at least one rotor blade changes the flow direction of the treatment bath in that way that the treatment bath mainly axially superfuses the pack cylinder and thus perfuses, particularly superfuses, as well as correspondingly displaces the textile goods to be treated that are arranged in the pack cylinder.

In order to cause a regular moving, particularly rotation, a further development of the hydraulic drive provides two to ten rotor blades. Hereby these rotor blades cause additionally to the drive also a division of the treatment bath entering into the vessel into corresponding partial flows, whereby the number of these partial flows can correspond to the number of the rotor blades.

It is particularly suitable if in the inventive device the at least one rotor blade, respectively the above mentioned number of rotor blades, are arranged, preferably detachably attached, to the bottom of the fabric carrier. Then, according to this embodiment, the corresponding treatment bath is entered at the bottom section of the cylindrical or cylinder-like vessel in that way that the treatment bath gets in contact with the rotor blade, respectively the rotor blades, which causes on one hand the moving, preferably the rotation, of the pack cylinder and on the other hand the change of the flow direction of the treatment bath in the direction of the pack cylinder and mainly axially through the pack cylinder.

In order to guarantee, according to the above mentioned embodiments of the inventive device that contain a hydraulic drive, the moving (actuation), particularly the rotation, of the pack cylinder and the desired axial superfusion of the pack cylinder, the shape of the at least one rotor blade and the arrangement of the inlet and thus the flow direction of the treatment bath have to be adjusted to each other. Hereby it is preferably advisable to provide the rotor blade with a bent surface, particularly an arched surface, whereby in this embodiment then the inlet is positioned and directed in that way that the treatment bath enters preferably tangentially into the vessel.

According to the inventive device the vessel bearing the fabric carrier basically can be formed in any way, if it is guaranteed that the fabric carrier can move, particularly rotate, within the vessel. However, the inventive device particularly disposes a cylindrical vessel, respectively a cylinder-like vessel, whereby then this cylindrical, respectively cylinder-like, vessel positions a cylindrical, respectively cylinder-like fabric carrier being a little bit smaller regarding its diameter in that way that the circular bottom section of the pack cylinder is arranged in a constant distance to the circular bottom of the vessel, which means that the central rotation axis of the pack cylinder is arranged in 90° angle relative to the bottom base of the vessel.

In order to achieve in the inventive device an impeccable bath superfusion of the textile goods to be treated that is arranged in the cylinder, it is advisable to dispose the bottom of the fabric carrier as a perforated bottom, whereby these perforations are preferably a multitude of circular passage bores. Hereby these passage bores have a diameter of between about 2 mm and about 15 mm, preferably about 4 mm and about 10 mm, whereby the size of the diameter depends on which ready-to-wear, textile apparel parts are treated.

Concerning the jacket surface of the fabric carrier it is to be noted that particularly when the textile goods to be treated are displaced only to a small extent because of their weight, the jacket surface contains only a few perforations arranged in the bottom section of the pack cylinder. For this reason it is guaranteed that the treatment bath mainly axially superfuses the whole content of the pack cylinder, without the generation of dead zones in the flow.

According to the above described embodiments containing a hydraulic drive, several possibilities exist to seal the ring section being required between the movable pack cylinder and the jacket of the vessel, underneath the pack cylinder and relative to the bottom section, so that caused by this ring sealing no undesired treatment bath can pass at the outside of the pack cylinder.

According to the first possibility of the afore mentioned sealing, the bottom of the fabric carrier is provided with a glide material essentially reducing on one hand the friction forces generating during the rotation of the pack cylinder, so that the pack cylinder can be rotated by relatively low forces. On the other hand this glide material causes at the same time also the above mentioned sealing.

At the bottom of the fabric carrier preferably an axial projecting part projecting over the bottom, particularly a ring-like projecting part, is arranged, whereby then the afore mentioned glide material is applied to this projecting part.

The second possibility is characterized in that a further development of the inventive device contains a sealing element being preferably provided to the bottom section of the fabric carrier and sealing the ring section being between the movable pack cylinder and the jacket of the vessel to the bottom section underneath the pack cylinder.

The two afore mentioned possibilities can evidently be combined with each other.

Particularly in the case of a formation of the at least one sealing element as a lip sealing or a labyrinth sealing, the above mentioned spaces are particularly effectively sealed from each other, so that the bath entering into the vessel superfuses the pack cylinder completely and thus also the textile goods to be treated.

As already mentioned repeatedly above the pack cylinder is positioned in the vessel in that way that it can move, preferably rotate, within the vessel. Hereby it is advisable to arrange the pack cylinder in the vessel in a rotatable position, whereby then the bottom section of the fabric carrier is provided with a corresponding bearing, particularly formed as a ring bearing. Then the ring bearing can optionally be attached to the bottom of the fabric carrier or to the bottom of the vessel, whereby in the latter case the ring bearing is supplied with a fixing element, so that after its entering the pack cylinder is fixed on the ring bearing.

A further, particularly suitable embodiment of the inventive device contains at least two pumps, whereby these pumps are arranged and connected in that way that they are employable optionally as pressure pumps to pump the treatment bath through the fabric carrier, as suction pumps to pump the treatment bath out of the fabric carrier or as well as pressure pumps and as suction pumps. By such an arrangement of the at least two pumps it is then possible to intensively perfuse, respectively to superfuse, and thus to correspondingly often displace the textile apparel parts to be correspondingly treated and being arranged in the fabric carrier, which is particularly desired during the treatment, whereby in this case the at least two pumps then work as pressure pumps. The at least two pumps according to the inventive device also work as pressure pumps, when the vessel of the inventive device in which the pack cylinder is entered for treatment purposes, is filled particularly fast with treatment bath at the beginning of a corresponding treatment to such an extent that this treatment bath perfuses, respectively superfuses, the textile goods in order to wet the apparel parts.

If contrarily the vessel according to the inventive device has to be, for example, rapidly emptied at the end of a corresponding treatment, then the at least two pumps are employed as suction pumps, in order to remove the treatment bath out of the fabric carrier and the vessel.

If on the contrary it is intended to change the flow direction of the treatment bath during the treatment, then at least one of the at least two pumps works during a given time interval as pressure pump and thus pumps the treatment bath through the fabric carrier, whereas during the same time interval the at least one other pump of the at least two pumps works as suction pump. After this first time interval the pump that worked as pressure pump is then, during a second time interval, employed as suction pump, whereas concurrently the pump that worked as suction pump is then, during this second time interval, employed as pressure pump.

The afore described embodiment of the inventive device particularly contains a suction pump as well as a pressure pump, both pumps are preferably connectable in that way that the suction pump also functions as pressure pump and the pressure pump also functions as suction pump.

Particularly when in the afore described embodiment of the inventive device the outlet of the pressure pump, respectively the outlets of the pressure pump or of the pressure pumps and the inlet of the suction pump, respectively the inlets of the suction pump or of the suction pumps are provided to the bottom section of the fabric carrier, preferably in the bottom section of the vessel, then such an embodiment of the inventive device allows a particularly low bath ratio, so that correspondingly this embodiment can be employed very economically for the treatment of ready-to-wear, textile apparel parts.

In order to cause a rapid and impeccable displacement of the ready-to-wear, textile apparel parts, a further embodiment of the inventive device is characterized in that each outlet of the pressure pump, respectively of the pressure pumps is formed as a nozzle. If additionally this nozzle is adjustable in respect to the direction of the outstreaming treatment bath, then in this embodiment of the inventive device the direction of the outstreaming treatment bath can be adjusted to the textile apparel parts correspondingly to be treated, which improves the treatment effects and which causes a gentle treatment of particularly sensitive textile goods and correspondingly shorter treatment times.

Another embodiment of the inventive device containing preferably at least one pressure pump and at least one suction pump, is characterized in that the outlet of the at least one pressure pump, the inlet of the at least one suction pump and/or the tube systems connected to the pumps contain each at least one regulating element being movable between a first position in which the flow rate of the treatment bath is reduced or interrupted, and a second position in which the flow rate of the treatment bath is not disturbed. For that reason the at least one regulating element serves as adjustable valve, whereby in the second position this valve is opened and makes it possible to set the flow rate of the treatment bath in respect to the time in any way in the first position. Such a regulating element avoids particularly effectively that an undesired cavitation meaning the formation of air bubbles or steam bubbles occurs at the suction side of the at least one pressure pump or suction pump.

If in the inventive device, instead of the afore described mainly axial superfusion of the fabric carrier, additionally also a radial or a radial/axial superfusion of the fabric carrier is desired, which again influences the manner of displacement of the ready-to-wear apparel parts to be treated and thus also the treatment results, then these alternatives of the radial or radial/axial superfusion of the fabric carrier can be achieved by an arrangement of the at least one outlet of the at least one pressure pump in the radially outer section of the fabric carrier (pack cylinder) in that way that during the treatment the textile apparel parts each to be treated are displaced in the direction of the radial middle of the pack cylinder.

Particularly when in the pack cylinder a mainly radial superfusion and thus also a mainly radial displacement or a concurrently radial and axial superfusion is intended, then it is advisable to dispose at least one inlet for the at least one suction pump in the radially middle section of the fabric carrier additionally to the afore described arrangement of the outlet of the at least one pressure pump.

In order to obtain a homogeneous superfusion of the fabric carrier in respect to the vessel dimensions and thus a homogeneous displacement of the textile apparel parts to be treated that are arranged in the pack cylinder, a further development of the afore described inventive device is characterized in that the bottom section of the fabric carrier is provided with two to ten, preferably three to eight inlets of the at least one suction pump and/or two to ten, preferably three to eight outlets of the at least one pressure pump.

These above described inlets and/or the corresponding outlets of the suction pump, respectively the pressure pump are preferably distributed over the bottom section of the vessel in such an asymmetrical manner that such an arrangement avoids the formation of dead zones in the flow.

For the proceeding with a particularly low bath ratio in the afore described embodiment of the inventive device, a further development of the inventive device is characterized in that the bottom of the vessel is vaulted to the exterior. In this vaulted bottom section then particularly the inlets of the at least one pump are arranged, so that the treatment bath assembles in this bottom section of the vessel, the bottom section vaulting to the exterior, which avoids particularly effectively that the at least one pump undesirably sucks up air bubbles or steam bubbles.

According to the firstly described embodiment of the inventive device the pack cylinder contains a hydraulic drive in order to effect the desired moving of the pack cylinder, particularly its rotation, during the treatment. Instead of this hydraulic drive or additionally to this hydraulic drive a further embodiment of the inventive device disposes an electrical drive rotating the pack cylinder particularly around its central, vertical axis at the rotating speeds indicated above in the inventive method, and thus the electrical drive guarantees a homogeneous perfusion, respectively superfusion, and concurrently also a regular displacement of the ready-to-wear apparel parts arranged in the pack cylinder.

In order to realize the afore described moving (actuation), particularly rotation, of the fabric carrier by means of an electrical drive, it is advisable the bottom base of the vessel contains a rotation element being driven from the exterior of the vessel, whereby this rotation element is detachably connected with the fabric carrier, particularly with the bottom section of the fabric carrier.

A particularly safe mounting of the fabric carrier is achieved in the afore described embodiment of the inventive device in that way that the rotation element is formed as a central bar extending over the axial length of the fabric carrier, whereby this central bar has at its bottom side a cone-like expansion for the detachable fixing of the fabric carrier, and at its upper side the central bar has at least one support section in that way that, when the vessel is closed, the support section is in contact with the cover of the vessel. Hereby the cover of the vessel is particularly supplied with a spindle that can be brought into contact with the support section of the central bar when the cover of the vessel is closed, so that during the rotation of the fabric carrier during the treatment the central bar functions as rotation axis for the fabric carrier and so that this rotation axis is safely mounted caused by the contact of the spindle at the support section and thus an impeccable rotation of the pack cylinder during the treatment is made possible.

Embodiments of the inventive device are preceedingly described that comprise at least two pumps being optionally employable as pressure pumps, as suction pumps or as pressure pumps and suction pumps. It is evidently also possible to substitute these at least two pumps by one pump, whereby this embodiment of the inventive device is then used for the treatment of correspondingly ready-to-wear, textile apparel parts having a relatively low weight. The embodiment of the inventive device comprising only one pump is also used when the corresponding device is only employed for the treatment of correspondingly small amounts of textile apparel parts as particularly amounts of a weight of between 20 kg and 150 kg.

In order to realize in the inventive device particularly such embodiments of the inventive method, according to which the textile goods to be treated are not only displaced but also intermingled at high speeds, a further embodiment of the inventive device is characterized in that hereby the fabric carrier is provided with a detachable, perforated cover, whereby also these perforations are formed, as it is described above for the perforations of the bottom, as circular passage bores with the afore indicated diameters.

If in the inventive device it is desired that the treatment bath superfuses the pack cylinder radially to the jacket surface of the pack cylinder, then it is advisable to divide the pack cylinder into two to ten, particularly two to eight section axially extending. Hereby the intermediate walls being required for the formation of the sections, extent over the total axial length of the pack cylinder, whereby the division of the pack cylinder into the afore mentioned sections has moreover the advantage that an undesired balling of the ready-to-wear, textile apparel parts while being displaced, respectively intermingled, is avoided, which particularly is important when the pack cylinder has a relatively high capacity for textile goods, for example of a weight of 500 kg to 1,000 kg.

It was preceedingly reported in connection with embodiments of the inventive device that the jacket surface of the fabric carrier has only a few perforations in the bottom section of the pack cylinder, whereby this formation of the pack cylinder is particularly used when the ready-to-wear apparel parts are only displaced to a relatively small extent because of their low weight.

If, however, with the inventive device such textile, ready-to-wear apparel parts are to be treated that are intensively displaced and particularly intermingled by the flow of the treatment bath during the treatment, then it is advisable to perforate the jacket surface of the cylindrical or cylinder-like fabric carrier and/or its bottom. These perforations allow that during the treatment the treatment bath being changed in direction by the ready-to-wear apparel parts rapidly reaches the bottom section of the vessel by means of the perforations, so that the bath ratio can be correspondingly reduced.

Basically the afore mentioned perforations being arranged in the jacket surface of the fabric carrier and/or in the bottom of the fabric carrier, are formed as bores with a diameter of between about 2 mm and about 15 mm, preferably with a diameter of between about 4 mm and about 10 mm. However, it is particularly suitable when these perforations are formed as tube-like bores protruding to the inside, since hereby it is made possible to exactly orientate the treatment bath streaming into the pack cylinder, in order to cause hereby not only a perfusion, respectively a superfusion, of the textile apparel parts to be treated but also an optimum displacement, particularly intermingling, of these apparel parts.

A particularly suitable embodiment of the inventive device refers to a dyeing vessel usually employed for the dyeing of yarns, whereby this usually employed dyeing vessel has a cylindrical body with a vaulted bottom. In order to reduce hereby the bath ratio even more, it is advisable to arrange a planar plate at the lowest point of the vessel bottom in such a way that the vessel obtains a planar bottom section that again closes up the cylindrical body from the vaulted vessel bottom.

In order to effect an entering, respectively a removal of the pack cylinder into the vessel, respectively out of the vessel, it is advisable to provide the vessel walling and/or the fabric carrier walling with elements guiding the fabric carrier during its entering and its removal. Hereby these guiding elements can be formed as, for example, axially extending ribs being arranged at the outer jacket of the fabric carrier and/or at the inner walling of the vessel.

Advantageous developments of the inventive method as well as of the inventive device are indicated in the subclaims.

BRIEF DESCRIPTION OF THE DRAWINGS

The inventive device is going to be explained more detailed subsequently by two examples in connection with the drawings. Hereby

In the FIGS. 1 and 2 the same parts are indicated with the same numbers.

DETAILED DESCRIPTION OF THE INVENTION

Figure 1:
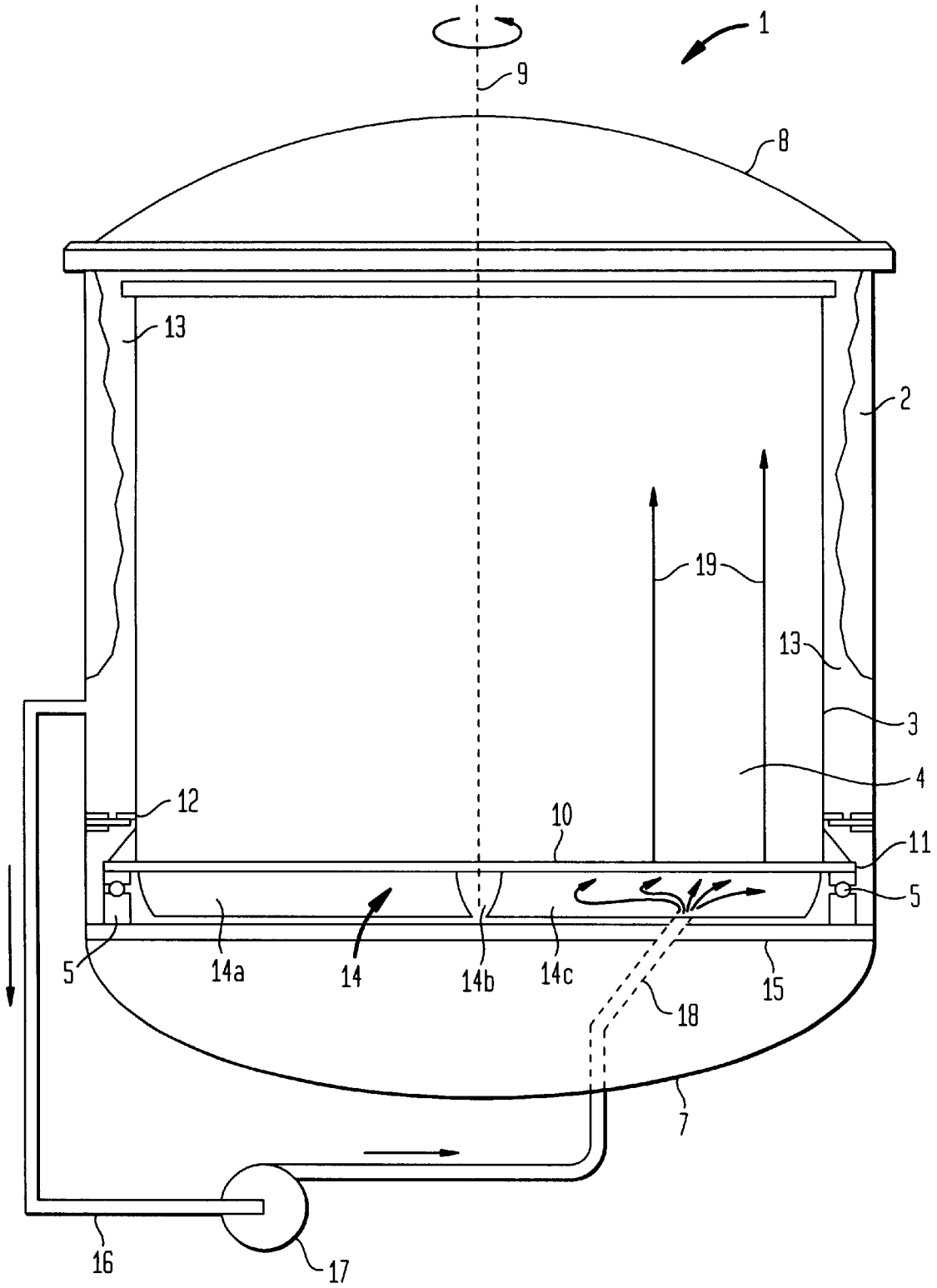
FIG. 1 shows a schematical side view of a first example of the device with a removed part of the vessel jacket.

A device in FIG. 1, the device being indicated with 1, contains a vessel having an arched bottom 7, a following cylindrical body 2 as well as an arched cover section 8, whereby the vessel corresponds, in respect to its shape, to a usual standing apparatus for dyeing yarns. A part of the jacket of the cylindrical body 2 is removed in the FIG. 1, so that the inner space of the vessel is opened.

A pack cylinder (fabric carrier) 3 is arranged within the vessel, whereby ready-to-wear, textile apparel parts are arranged for the treatment as a heap of ready-to-wear, textile apparel parts in the interior 4 of the pack cylinder 3. The textile, ready-to-wear apparel parts each to be treated are not shown in FIG. 1.

The pack cylinder 3 is arranged in that way that it can rotate around its central, vertical axis 9 by means of a ring bearing 5, as this is indicated in FIG. 1 by the arrow above the cover section 8. Hereby the ring bearing 5 comprises a multitude of steal balls being coated with an inert plastic, particularly teflon. The ring bearing 5 is arranged in the bottom section 11 of the pack cylinder 3.

A lip sealing 12 is arranged above the ring bearing 5, whereby this lip sealing 12 extends over the total circumference of the inner jacket of the cylindrical body 2, and closes up the ring section 13 above the lip sealing 12 from the space underneath the lip sealing 12.

A hydraulic drive indicated in the whole with 14 is arranged underneath the bottom 10 of the pack cylinder, whereby the bottom is provided with a multitude of perforations not shown. Hereby the hydraulic drive 14 comprises rotor blades 14*a*, 14*b* and 14*c* being arranged crucially to each other. Each rotor blade is arched in respect to its profile and extends from the radial edge of the pack cylinder to the radial middle of the pack cylinder, whereby the rotor blades 14*a*, 14*b* and 14*c* crucially arranged are attached to the bottom 10 of the pack cylinder 3 relative to each other in an 90° angle.

The lower and vaulted bottom section 7 has a planar plate 15 closing up the this bottom section 7 from the rest of the inner space of the vessel. Moreover the vessel is supplied with a bath circulation system for transporting of the treatment bath, whereby the bath circulation system consists of a conduct drawing off the bath 16, a pump 17 and a conduct entering the bath 18, the outlets of which being arranged tangentially to the rotor blades 14*a*, 14*b* and 14*c*, as this is shown for rotor blade 14*c* in the FIG. 1. Furthermore the bath circulation system contains a heat exchanger, a dogging vessel and/or a corresponding fluff filter.

The device 1 described above and shown in FIG. 1 proceeds as follows:

First of all the ready-to-wear, textile apparel parts are arranged in the pack cylinder 3 in the form of a heap of apparel parts being loosely packed, whereby in this packing step the pack cylinder 3 is arranged in the exterior of the device 1. In order to facilitate a later removal of the ready-to-wear apparel parts (textile goods), it is advisable to envelope the textile goods into corresponding nets.

After the pack cylinder 3 being externally packed it is entered into the device 1 by means of a crane. After closing the cover the device 1 is filled with bath, which causes the required wetting of the textile goods. As soon as the device 1 is filled with treatment bath this treatment bath is pumped by means of the conduct 16, the pump 17 and the conduct 18 in such a way that the bath streams out of conduct 18, as this is shown in FIG. 1 by the arrows in the section of the outlet of conduct 18. Hereby the outstreaming treatment bath firstly gets in contact with one of the rotor blades 14*a*, 14*b* and 14*c* of the hydraulical drive 14, which causes a rotation of the cylinder around its central, vertical axis. The impact of the outstreaming bath onto the corresponding rotor blade furthermore causes the fact that the flow direction of the bath is changed and that the bath mainly and vertically superfuses the perforated bottom 10 of the pack cylinder 3 and the textile goods arranged in the pack cylinder, as this is exemplarily shown by the arrows 19. The fact that this stream does not flow as vertically as it is indicated by the arrows 19, depends evidently on the rotation speed of the pack cylinder. Hereby rather a more or less helix-like superfusion of the textile goods takes place, whereby, however, the main stream direction is effected in vertical direction and thus in direction of the arrows 19, since the jacket of the pack cylinder 3 has no perforations. This manner of superfusion is designated above with mainly vertical.

As soon as the treatment bath superfusing the textile goods overflows the upper rim of the pack cylinder being additionally closed with the perforated cover and as soon as the treatment bath reaches the ring section 13, the treatment bath is drawn off by conduct 16 and reentered over the outlet of conduct 18 by the pump 17.

Figure 2:
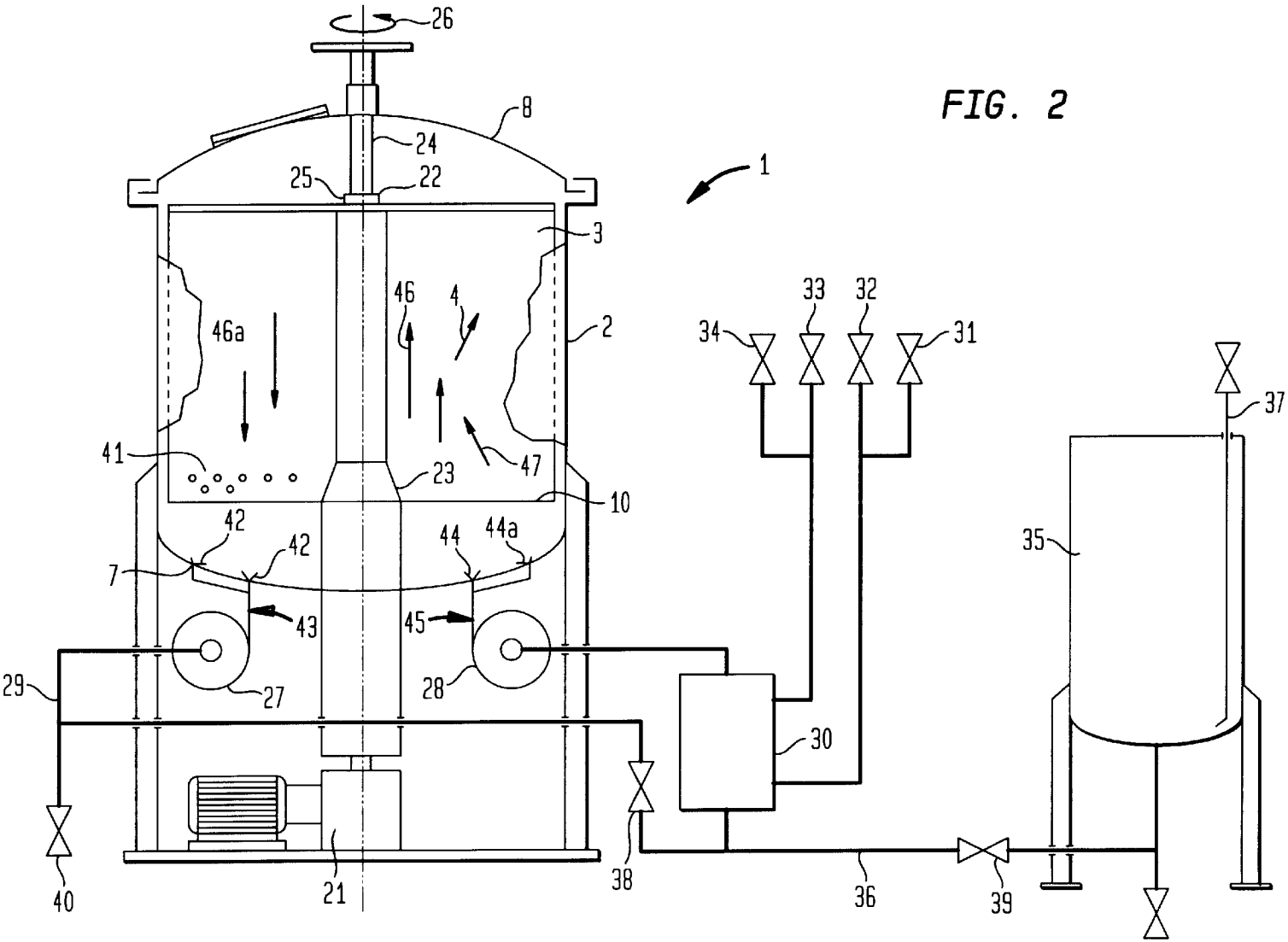
FIG. 2 shows a schematical side view of a second example of the device.

A second embodiment of the device is shown in FIG. 2. The device being indicated in a whole with 1, contains a vessel having an arched bottom 7, a following cylindrical body 2 as well as an arched cover section 8, whereby the vessel corresponds in respect to its shape to a usual standing apparatus for the dyeing of yarns. A part of the walling of the cylindrical body 2 is removed in the second embodiment of the device 1 shown in FIG. 2, so that in FIG. 2 the inner space of the vessel lays open.

A fabric carrier (pack cylinder) 3 is arranged within the vessel, whereby in the interior 4 of the pack cylinder 3 not shown ready-to-wear apparel parts are arranged for the treatment in the form of a heap of apparel parts.

The bottom 10 of the pack cylinder 3 is arranged in a distance from the bottom 7 of the vessel. From a drive 21 being arranged underneath the vessel a central bar 22 extends almost up to the cover 8 of the vessel, whereby the central bar 22 comprises at its bottom side a cone-like expansion 23 in the section of the bottom 10 of the pack cylinder. At its upper side the central bar 22 is provided with a support section 25, whereby, the cover 8 being closed, the support section 25 is in contact with a spindle 24 in that way that the pack cylinder 3 is safely fixed during a rotation in direction of the arrow 26 or in the contrary direction, whereby the rotation is effected by the electrical drive 21 and the central bar 22 connected with the electrical drive 21.

A suction pump 27 and a pressure pump 28 are arranged underneath the vessel, whereby the both pumps 27 and 28 are connected with each other by a corresponding tube conduct 29 and a heat exchanger 30.

From a dogging vessel 35 the heat exchanger 30 is fed with treatment bath by a corresponding tube circulation system 36, as this is schematically shown in FIG. 2. The dogging vessel 35 can be heated optionally directly or indirectly.

Moreover the heat exchanger 30 can be cooled, respectively heated, by corresponding tube conducts 31 to 34 being provided with a corresponding number of valves, whereby the cooling water inflow is designated with 31, the steam supply with 32, the steam backflow with 33 and the cooling water backflow with 34.

In FIG. 2 the valves are designated with 38 to 40, whereby over the valves 38 and 39 the treatment bath is fed and valve 40 is formed as drain valve.

The jacket surface of the pack cylinder 3 is provided with a multitude of perforations 41 in the bottom section 10, whereby these perforations 41 are arranged only in the lower section of the pack cylinder 3. Also the bottom 10 of the pack cylinder 3 contains corresponding perforations.

The suction pump 27 has a multitude of inlets 42 being distributed over the bottom 7 of the vessel 2, whereby a not shown regulating element is positioned in the area designated with 43, whereby this regulating element is positioned streamdown of the connection of the inlet 42 multitude before the pump 27 in the corresponding tube system.

The pressure pump 28 contains a multitude of outlets 44, whereby a regulating element is arranged in the area designated with 45, whereby this regulating element is arranged also streamdown of the pump 28 and before the branching of the multitude of outlets 44.

By the afore described regulating elements being arranged in the areas 43 and 45 and being preferably formed as throttle flaps, it is made possible to regulate the flow of treatment bath through the pumps 27 and 28 in respect to the time in that way that the throttle flaps are adjustable between a first position in which the flow rate of treatment bath is blocked or reduced, and a second position in which the flow rate of treatment bath is not disturbed.

The nozzle-like formed inlets 42 and outlets 44 are arranged in the way that the bath being entered by the pressure pump 28 superfuses the cylindrical pack cylinder 3 mainly in an axial manner, as this is indicated by the arrows 46.

Conditioned by the fact that the right outlet nozzle 44 a being shown only exemplarily is arranged in direction of the radial center of the pack cylinder 3, this nozzle causes, additionally to the described flow flowing mainly in an axial manner in direction of the arrows 46, a flow flowing radially to the interior, as this is shown by the arrow 47.

The suction pump 27 causes the fact that by its inlet 42 the bath is sucked out of the pack cylinder 3 in direction of the arrow 46*a*.

It was described above in connection with the pumps 27 and 28 that pump 27 is employed as suction pump and pump 28 as pressure pump. If contrarily the pumps are formed as rotation pumps, then these pumps can also be employed differently depending on the installed electrical circuit of the pump drives. For that reason it is possible to employ both pumps 27 and 28 concurrently as pressure pumps or as suction pumps, whereby in the first case the corresponding vessel is then particularly rapidly filled with the treatment bath from the dogging vessel 35 by the opened valve 39, the tube system 36, the heat exchanger 30 and the tube system 29, and in the second case the vessel is emptied over the turned off heat exchanger 30, the opened valve 38 and the tube system 29 as well as over the opened valve 41. It is also possible that both pumps 27 and 28 rotate in the same direction during the treatment, so that the treatment bath is conveyed either in the way as it is shown in FIG. 2 by the arrows 46, 46*a* and 47, or the treatment bath is pumped through the fabric carrier 3 oppositely to the flow direction indicated in FIG. 2 by the arrows 46, 46*a* and 47. Concerning particularly sensitive ready-to-wear, textile apparel parts, it is moreover possible to turn off the pump functioning as suction pump, so that thereby the treatment bath passes this pump without being conveyed through the suction pump.

The afore described device shown in FIG. 2 proceeds as follows:

First of all the ready-to-wear, textile apparel parts to be treated are arranged in the pack cylinder 3 in the form of a loosely packed heap of apparel parts, whereby in this packing step the pack cylinder 3 is arranged outside of the device 1. In order to facilitate a later removal of the ready-to-wear apparel parts, the pack cylinder 3 is divided into six sections, whereby each not shown section extends over the total axial length of the pack cylinder.

After the pack cylinder 3 was packed externally, it is entered into the device 1 by means of a crane. After the cover 8 was closed the device 1 is filled with treatment bath from the dogging vessel 35, over the opened valve 39, the tube system 36, the heat exchanger 30 and the pressure pump 28 as well as, if need be, over the suction pump 27 being employed in this operating method also as pressure pump, whereby the treatment bath is pumped into the vessel 2 only to that extent that the bath level in the vessel 2 reaches up to about the height where the bottom 10 of the pack cylinder 3 is arranged.

After the filling of the vessel 2 the valve 39 is closed, whereas the valve 38 is opened. At the same time the suction pump 27 is put into use, so that the bath is entered into the pressure pump 27 over the inlets 42, the suction pump 27, the tube system 29, the opened valve 38 and the heat exchanger 30 in that way that the pressure pump 28 presses the treatment bath into the pack cylinder at a pressure of between about 2 bar and about 10 bar over the outlets 44 and the perforations in the bottom section 10 of the pack cylinder, so that correspondingly the ready-to-wear, textile apparel parts being arranged in the pack cylinder 3 are perfused, superfused and particularly also displaced by treatment bath.

If the ready-to-wear, textile apparel parts are particularly sensitive the suction pump 27 can be turned off, as this is described above, so that the treatment bath is only pumped through the pressure pump 28.

If a change of the flow direction of the bath, meaning a bath guiding in the opposite direction of the indicated arrows 46, 46*a* and 47, is desired, then the pumps 27 and 28 are electrically connected in that way that thereby the pump 28 functions as suction pump and the pump 27 as pressure pump.

If the ready-to-wear, textile apparel parts are particularly sensitive the pump 28 functioning then as suction pump 27 can be turned off, as this is described above, so that the treatment bath is pumped only through the pump 27 functioning then as pressure pump.

The pack cylinder 3 is rotated in direction of the arrows 26 or in the opposite direction by the drive 21 during the filling as well as during the treatment.

After the treatment is finished the treatment bath is drained out of the vessel 2, whereby the bath can be drained out of the vessel 2 by the pump 27 or by the pump 28 functioning then as suction pump or by both pumps 27 and 28 functioning as suction pumps and by the opened valve 40.

The vessel 2 can also be filled particularly rapidly in an analogue manner in that way that the pump 27 as well as the pump 28 each functions as suction pumps and that these pumps transport the treatment bath from the dogging vessel 35 and the opened valves 39 and 38 into the vessel 2.

After the treatment is finished the pack cylinder 3 is removed out of the vessel 2 and replaced by a fabric carrier 3 being externally packed in the meantime.

What is claimed is:

1. A device for treating ready-to-wear textile apparel parts, comprising:

a vessel having a bottom section and a bottom, the bottom section and bottom forming a space therebetween;

an electric drive;

a cylinder-like fabric carrier for receiving the ready-to-wear textile apparel parts having a circular bottom, a cylindrical jacket, a central, vertical axis, and a bottom section, said carrier being movably and detachably disposed in said vessel, being aligned substantially parallel to the vessel space, the carrier being connected to said electric drive;

a system for circulating a treatment bath in said carrier so as to create a flow of the treatment bath, said system having at least one pump for pumping the treatment bath;

at least two pumps capable of being employed at the same time as pressure pumps to pump the treatment bath through said fabric carrier, as suction pumps to pump the treatment bath out of said fabric carrier, or as pressure and suction pumps each of said at least two pumps having an outlet and an inlet; and a rotating element detachably connected to said fabric carrier and disposed at the bottom section of said vessel whereby said rotating element is actuated from outside of said vessel, said rotating element comprising a central bar extending through the central, vertical axis, the central bar having a bottom part with a cone-like expansion for the detachably connecting to said fabric carrier, and having an upper part with at least one support section in contact with a cover of said vessel.

2. The device according to claim 1 wherein said at least two pumps comprise a suction pump and a pressure pump, and wherein the outlet of said pressure pump or the inlet of said suction pump is disposed at the bottom of said fabric carrier.

3. The device according to claim 2 wherein the outlet of said pressure pump is a nozzle.

4. The device according to claim 1 further comprising at least one regulating element disposed at the outlet, the inlet or a tube system connected to each of the outlet and the inlet, said at least one regulating element being movable between a first position in which the flow of the treatment bath is reduced or stopped and a second position in which the flow of the treatment bath is not disturbed.

5. The device according to claim 1 wherein at least one outlet or inlet of said at least one pump is arranged in the cylinder jacket in such a way that the textile apparel parts to be treated are displaced toward the middle of the cylinder jacket.

6. The device according to claim 5 wherein the at least one inlet for said at least one suction pump is provided in the middle of the cylinder jacket.

7. The device according to claim 1 wherein the carrier bottom has two to ten inlets or outlets.

8. The device according to claim 7 wherein the carrier bottom has three to eight inlets or outlets.

9. The device according to claim 8 wherein the inlets or outlets are distributed asymmetrically over the carrier bottom.

10. The device according to claim 1 wherein the bottom section of said vessel is formed as a vault.

11. The device according to claim 1 wherein said fabric carrier has a detachable, perforated cover.

12. The device according to claim 1 wherein said fabric carrier has two to ten sections extending axially.

13. The device according to claim 10 wherein said fabric carrier has two to eight sections extending axially.

14. The device according to claim 1 wherein the cylindrical jacket or the bottom of said carrier is perforated.

15. The device according to claim 14 wherein the perforations comprise tube-like bores.

16. The device according to claim 11 wherein said vessel further comprises elements disposed so as to guide said fabric carrier during its insertion into said vessel.

17. The device according to claim 16 wherein the guide elements are disposed in walls of said vessel.

18. The device according to claim 1 wherein said vessel has a planar bottom.

* * * * *